US006383119B1

(12) United States Patent
Cattoni et al.

(10) Patent No.: US 6,383,119 B1
(45) Date of Patent: May 7, 2002

(54) CHILDREN'S MOLDED PLAY CAR/ VEHICLE

(75) Inventors: Don F. Cattoni, Huntersville, NC (US); Michael J. Clarke, Chalfont, PA (US); Jonathan E. Brooks, Charlotte; Bradley B. Hobday, Davidson, both of NC (US); Michael S. Jaeb, Millersburg, OH (US); Keith C. Nagelski, Huntersville, NC (US)

(73) Assignee: Soft Play, L.L.C., Charlotte, NC (US)

( * ) Notice: Subject to any disclaimer, the term of this patent is extended or adjusted under 35 U.S.C. 154(b) by 0 days.

(21) Appl. No.: 09/553,658

(22) Filed: Apr. 21, 2000

(51) Int. Cl.[7] ..... A63H 3/16
(52) U.S. Cl. ..... 482/35; 446/99; 446/476
(58) Field of Search ..... 482/35, 36; 446/97, 446/99, 100, 85, 476, 478

(56) References Cited

U.S. PATENT DOCUMENTS 5,387,165 A * 2/1995 Warren ..... 482/35
6,210,247 B1 * 4/2001 Ferre ..... 446/99

* cited by examiner

*Primary Examiner*—Glenn E. Richman
(74) *Attorney, Agent, or Firm*—Polster, Lieder, Woodruff & Lucchesi

(57) ABSTRACT

A one-piece molded plastic vehicular enclosure for children is disclosed. The vehicular enclosure, which can either be a car or truck configuration, has a length substantially greater than its width and height. The enclosure includes opposing top and bottom surfaces and opposing side surfaces inner connecting the top and bottom surfaces. The enclosure further includes opposing front and rear surfaces extending between the top and bottom surfaces and side surfaces. The rear surface includes a rear entry opening for ingress and egress of children into and out of the enclosure. The rear entry opening is defined by a cylindrical extension projecting from the rear surface. The rear entry opening has a height and width substantially equal to the distance between the top and bottom surfaces to facilitate ingress and egress into the enclosure by children. Preferably, the rear entry opening is sufficiently large to permit two children to pass one another during ingress and egress relative to the enclosure.

16 Claims, 6 Drawing Sheets

CHILDREN'S MOLDED PLAY CAR/ VEHICLE

CROSS REFERENCE TO RELATED APPLICATIONS

None.

STATEMENT REGARDING FEDERALLY SPONSORED RESEARCH OR DEVELOPMENT

None.

BACKGROUND OF THE INVENTION

The present invention seeks to overcome the limitation of prior art components by the development of a vehicular enclosure design/configuration that looks like a car or truck. This is accomplished by producing a multipurpose generic looking car or truck, preferably molded as a one-piece unit, having graphics and play accessories added to change the look of the car or truck. For example, with graphics and play accessories added, the car can be changed to look like a police car, racing car, and the like while the truck can be changed to look like a fire truck, loader, bulldozer and the like. The result is that children will play with a more realistic looking unit with which they will become more familiar in later life.

Children love crawling through a maze of interconnected tubular play structures typically located at various fast food restaurants. These tubular structures are connected to different styles of climbing units, modular components, corner units and other connecting structure to create a multi-level climbing experience for children. To enhance the climbing and play experience, a variety of components have been incorporated into such interconnected tubular play structures. For example, a recreational equipment junction box for comer connections is disclosed in U.S. Pat. No. 5,387,165; a transparent junction ball is disclosed in U.S. Pat. No. 5,540,636; and a variety of different vertical lateral, rocking-type and multi-directional equipment devices are shown, respectively in U.S. Pat. Nos. 5,669,855; 5,692,993; 5,695,407 and 5,683,301. While all of these components enhance the play experience and most include the use of transparent windows to facilitate viewing by children from within the components, they have not been designed to simulate or look like vehicular enclosures, such as cars and trucks. Thus, children cannot enjoy realistic pre-driving play experience in such prior art component play structures.

The present invention seeks to overcome the limitation of prior art components by the development of a vehicular enclosure design/configuration that looks like a car or truck. This is accomplished by producing a multi-purpose generic looking car or truck, preferable molded as a one-piece unit, having graphics and play accessories added to change the look of the car or truck. For example, with graphics and play accessories added, the car can be changed to look like a police car, racing car, and the like while the truck can be changed to look like a fire truck, loader, bulldozer and the like. The result is that children will play with a more realistic looking unit with which they will become more familiar in later life.

In addition to vehicular enclosures for use in connection with interconnected tubular play structures the vehicular enclosure car or truck design/configuration can also be used in free standing playground units, as well.

BRIEF SUMMARY OF THE INVENTION

Among the several objects and advantages of the present invention are:

The provision of a vehicular enclosure, such as a car or truck, for use with interconnected tubular play structures or free standing playground units;

The provision of the aforementioned vehicular enclosure which can be formed either as a car or truck;

The provision of the aforementioned vehicular enclosure which is designed/configured as a multi-purpose generic unit which, when modified by graphics and play accessories, can be changed to look like different types of cars and trucks;

The provision of the aforementioned vehicular enclosure which is formed as a one-piece molded plastic unit that incorporates a rear entry opening for ingress and egress of children;

The provision of the aforementioned vehicular enclosure in which the rear entry opening is sufficiently large to permit two children to pass one another during ingress or egress relative to the enclosure; and The provision of the aforementioned vehicular enclosure which includes windows and simulated driving components such as a steering wheel to enhance the play experience.

These and other objects and advantages of the present invention will become more apparent from the description that follows.

Briefly stated, the present invention includes a one-piece molded plastic vehicular enclosure for children. The enclosure has a length substantially greater then its width and height and includes opposing top and bottom surfaces and opposing side surfaces interconnecting the top and bottom surfaces. Further, the enclosure includes opposing front and rear surfaces extending between the top and bottom surfaces and side surfaces. The rear surface includes a rear entry opening for ingress and egress of children into and out of the vehicular enclosure. The rear entry opening has a height and width substantially equal to the distance between the top and bottom surfaces to facilitate ingress and egress into the vehicular enclosure by children. Preferably, the rear entry opening is defined by a cylindrical extension that extends from the rear surface.

The vehicular enclosure may be either a car or truck which includes windows to facilitate viewing by children. For this purpose, non-transparent window areas are removed from the one-piece molded plastic vehicular enclosure and replaced by transparent windows attached to the enclosure.

The multi-purpose generic vehicular enclosure structure, configured either as a car or truck, can be changed to look like a variety of different cars or trucks, depending on graphics and accessories added to visually change the overall look of the vehicular enclosure. Within the vehicular enclosure, simulated driving components including a steering wheel may also be provided.

The vehicular enclosure through its cylindrical extension may be connected to interconnected tubular play structures, or alternatively, a vehicular enclosure may be used as a free standing playground unit.

BRIEF DESCRIPTION OF THE SEVERAL VIEWS OF THE DRAWINGS

The objects of the invention are achieved as set forth in the illustrative embodiments shown in the drawings which form a part of the specification.

In the drawings.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
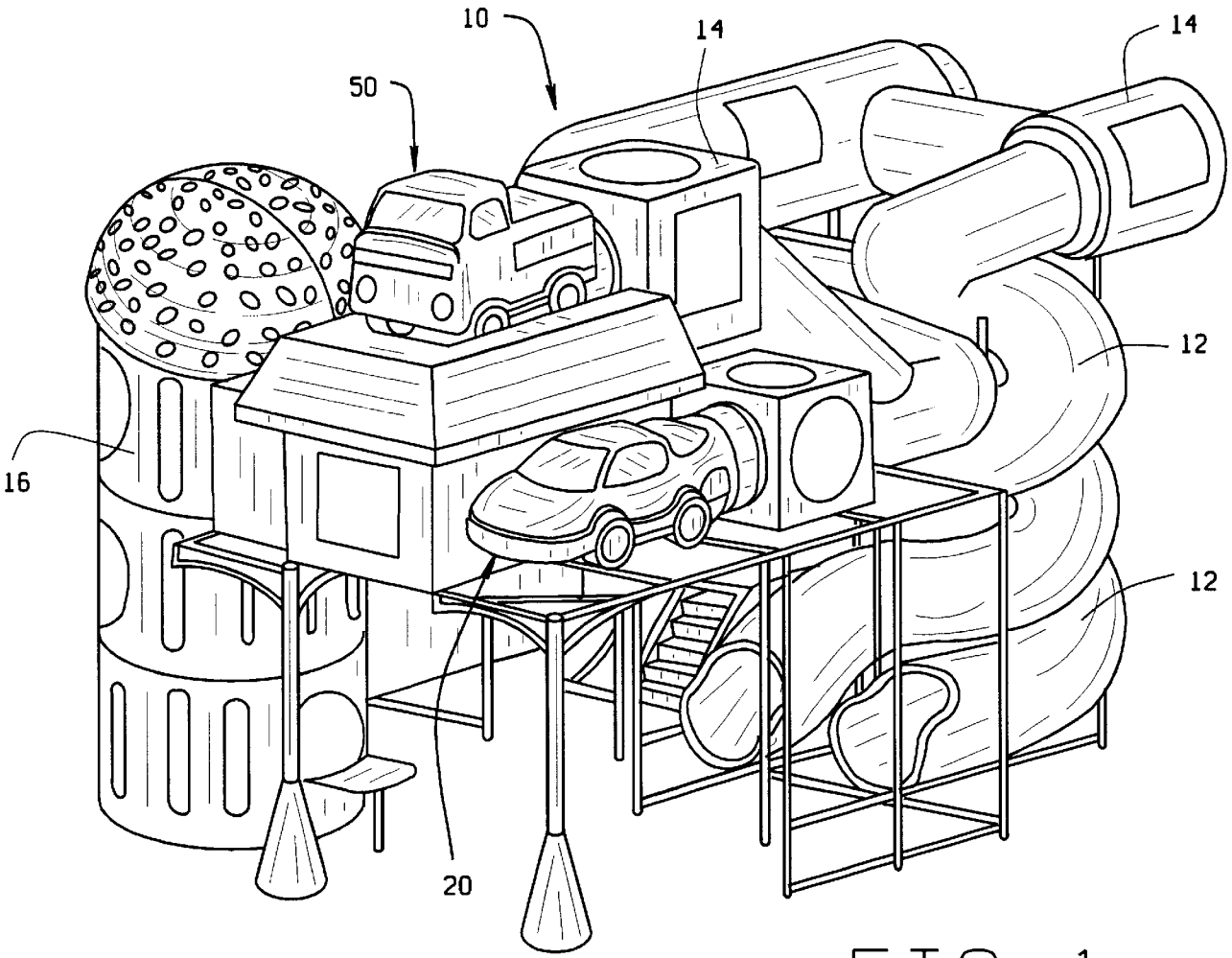
FIG. 1 is a perspective view of an interconnected tubular play structure that incorporates two different vehicular enclosures, one configured as a car and the other configured as a truck.
Figure 2:
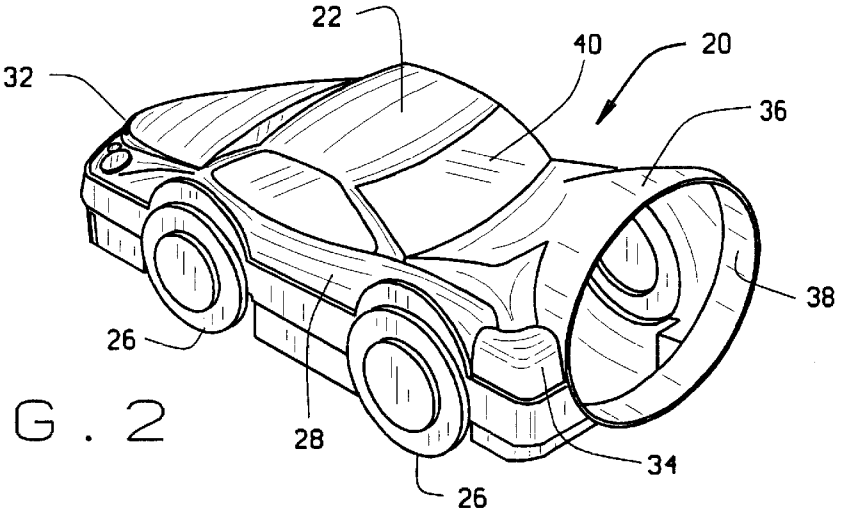
FIG. 2 is a perspective view of a car vehicular enclosure that is constructed in accordance with the teaching of the present invention.

Referring first to FIG. 1 of the drawings, there will be seen an interconnected tubular play structure 10 having a series of interconnected tubes 12 which are joined to a variety of different corner components 14 and a climbing structure 16 to enable children to enjoy a multi-level play experience by crawling through the variety of interconnected tubes 12, the components 14, as well as the climbing structure 16. Incorporated within the interconnected tubular play structure 10 are two types of vehicular enclosures constructed in accordance with the teaching of the present invention including a car 20 and a truck 50. The car 20 will be further described in connection with FIGS. 2–7 and 15 of the drawings while the truck 50 will be further described in connection with FIGS. 8–14 and 16–17 of the drawings.

Figure 15:
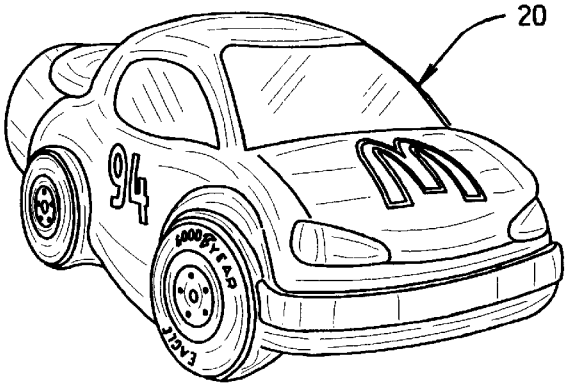
FIG. 15 is a front perspective view of the car shown in FIG. 2 including different graphics and play accessories to show a race car type design.
Figure 16:
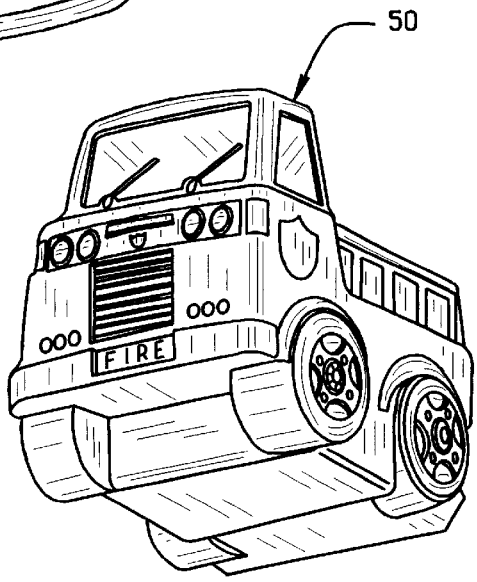
FIG. 16 is a front perspective view of the truck shown in FIG. 8 with graphics and play accessories to change the look of the truck to a fire truck.

As will be appreciated, both the car 20 and the truck 50 resemble realistic car and truck designs/configurations with which children are familiar. Both the car 20 and truck 50 are formed as multi-purpose units. However, the look of the car 20 and truck 50 can be changed by adding graphics and accessories as shown in FIGS. 15 and 16, respectively, as will be described further below.

Referring now to the car vehicular enclosure shown in FIGS. 2–7 of the drawings, the car 20 is formed as a multi-purpose generic looking design/configuration. For this purpose, the car is rotomolded as a one-piece molded plastic product, preferably from polyethylene, to provide a light weight, durable unit with a desired multi-purpose generic design/configuration.

Figure 4:
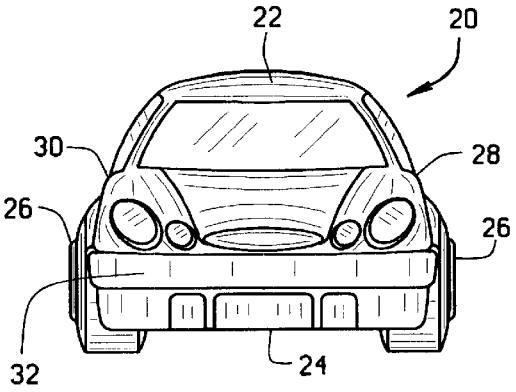
FIG. 4 is a front elevational view of the car shown in FIG. 2.
Figure 5:
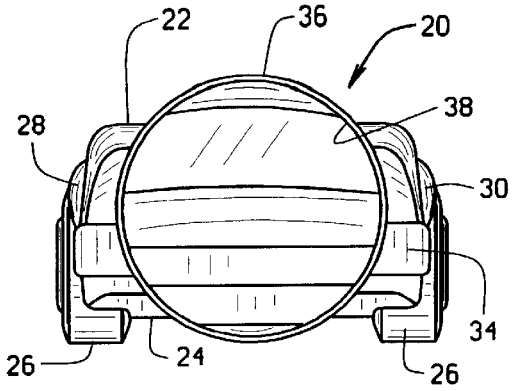
FIG. 5 is a is a rear elevational view of the car shown in FIG. 2.
Figure 6:
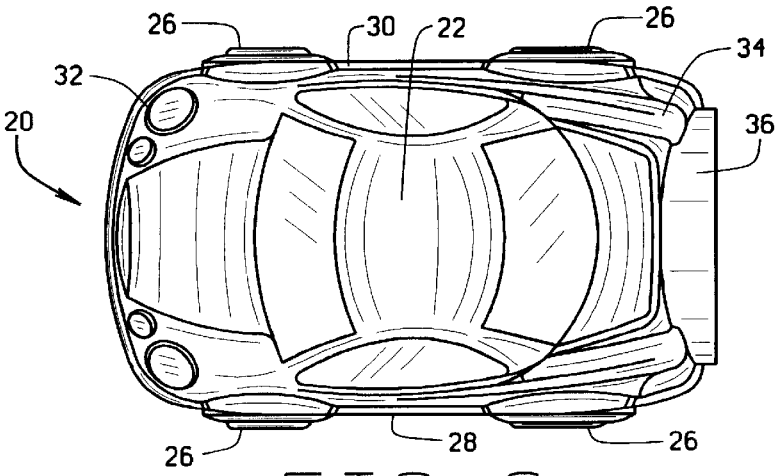
FIG. 6 is a top plan view of the car shown in FIG. 2.
Figure 7:
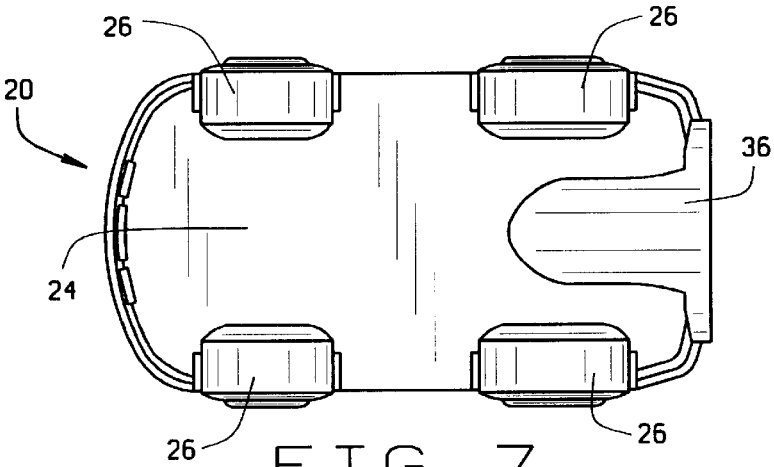
FIG. 7 is a bottom plan view of the car shown in FIG. 2.
Figure 8:
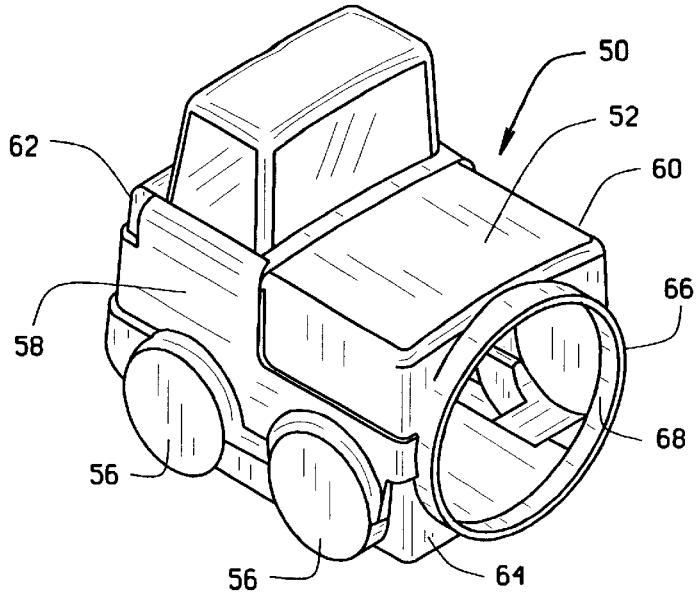
FIG. 8 is a rear perspective view of a truck vehicular enclosure constructed in accordance with the teachings of the present invention.

As best seen by comparing FIGS. 4–5 with FIGS. 6–7, the car has a length substantially greater than its width and height and includes opposing top and bottom surfaces 22, 24. The top surface 22 represents the overall look of the hood, occupant area and truck of the car while the opposing bottom surface 24 has a generally planar configuration with the exception of the integrally formed tires 26. Opposing side surfaces 28, 30 interconnect the top and bottom surfaces 22, 24 and resemble the side areas of the car including side surface areas forming the wheels 26, on opposite sides.

The one-piece molded car 20 further includes opposing front and rear surfaces 32, 34 extending between the top and bottom surfaces 22, 24 and opposing side surfaces 28, 30. The front surface 32 resembles the front area of the hood including lights and bumper, while the rear surface 34 represents the rear area of the trunk and bumper of the molded car 20.

The rear surface 34 further includes a cylindrical extension 36 defining a rear entry opening 38 for ingress and egress of children into and out of the car 20. The rear entry opening 38 is the only opening into the car 20 through which children can enter and exit the car 20. It will be seen that the rear entry opening 38 has a height and width substantially equal to the distance between the opposing top and bottom surfaces (see FIGS. 3 and 5) to facilitate ingress and egress into the molded car 20. In this regard, the rear entry opening 38 is sufficiently large to enable two children to pass one another during ingress and egress into the molded car 20.

Figure 3:
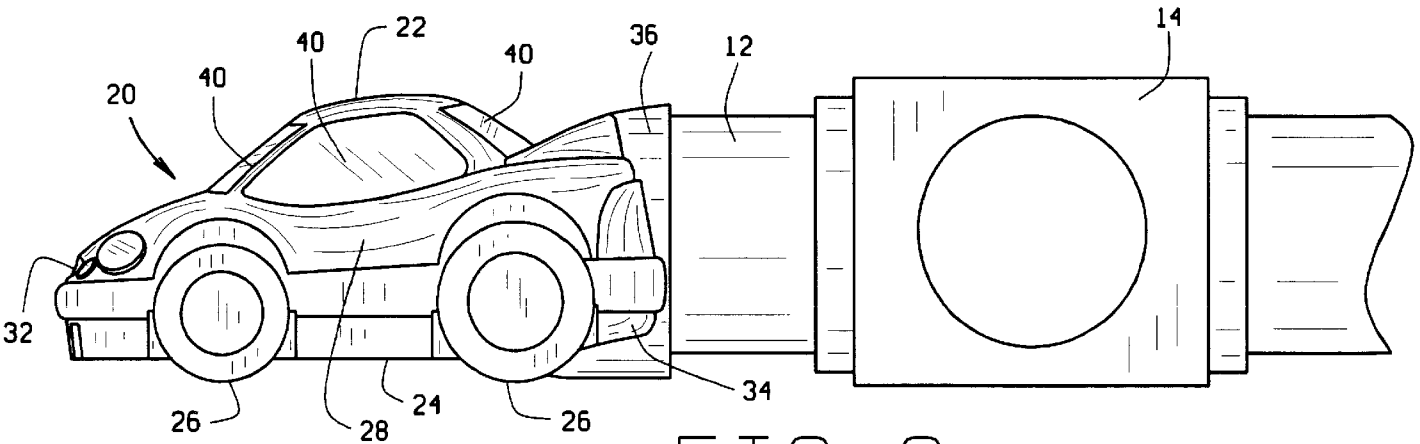
FIG. 3 is a side elevational view of the car shown in FIG. 2 illustrating the manner in which it can be connected to interconnected tubular play structure.

Attachment of the molded car 20 to interconnect the play structure 10 is shown in FIG. 3 of the drawings where interconnected tubular structure 12 is connected to the cylindrical extension 36, thus enabling children to crawl through the tubes directly into the molded car 20 through the rear entry opening 38. Alternatively, in a free standing playground environment, children would enter molded car 20 directly through the rear entry opening 38.

To enhance the play experience, molded car 20 is provided with a transparent windows 40 that are separately attached to the molded car 20. Initially, the molded car is formed with non-transparent window areas that are removed from the molded car 20 and replaced by transparent windows 40 preferably made from a polycarbonate material, that are separately attached to the car through any one of a variety different fastening techniques, as will be appreciated.

Figure 14:
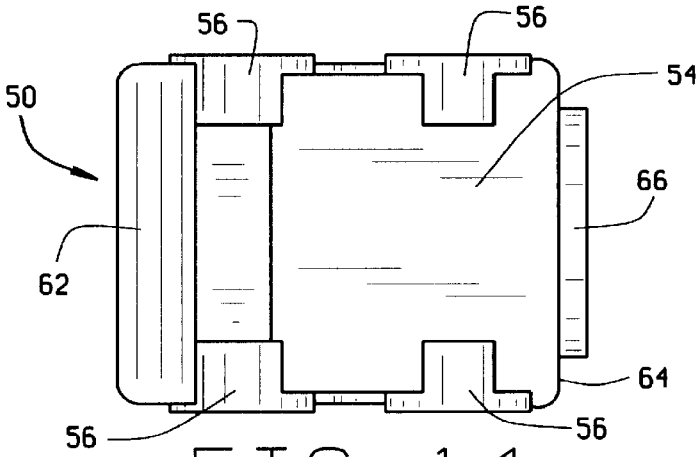
FIG. 14 is a bottom plan view of the truck shown in FIG. 14.

In addition to a molded car 20, the present invention contemplates a multi-purpose generic truck 50 as shown in FIGS. 8–14 of the drawings. In this instance, the truck 50 is also formed as a multi-purpose generic looking truck design/configuration that also has a length substantially greater than its width and height, as shown in the drawings. The molded truck 50 includes opposing top and bottom surfaces 52, 54, respectively; the top surface 52 representing the top area of the truck while the bottom surface 54, as shown in FIG. 14, includes a generally planar area with the exception of the bottom areas forming the four wheels 56.

Interconnecting the opposing top and bottom surfaces 52, 54 are opposing side surfaces 58, 60. The opposing side surfaces 58, 60 represent the side areas of the molded truck 50 which also include, in part, the side areas forming the four tires 56.

Figure 9:
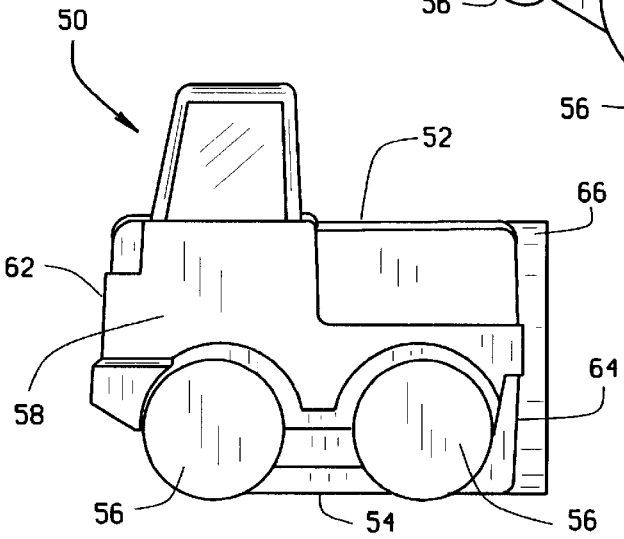
FIG. 9 is a left side elevational view of the truck shown in FIG. 8.
Figure 10:
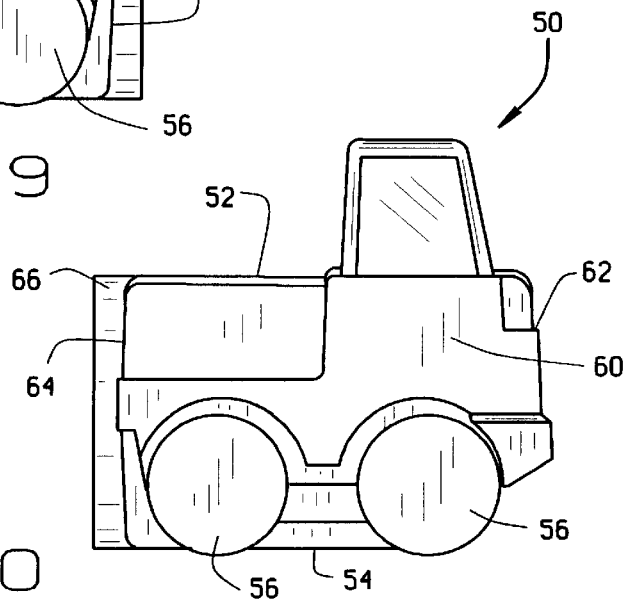
FIG. 10 is a right side elevational view of the truck shown in FIG. 10.
Figure 11:
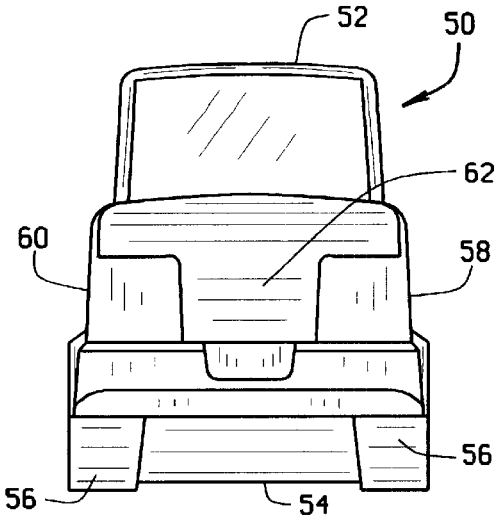
FIG. 11 is a front elevational view of the truck shown in FIG. 8.
Figure 12:
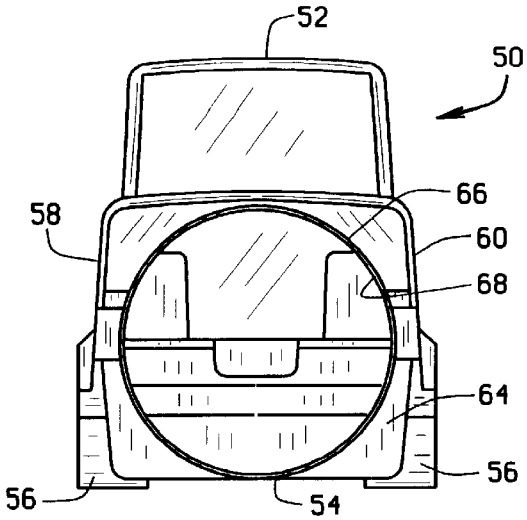
FIG. 12 is a rear elevational view of the truck shown in FIG. 8.
Figure 13:
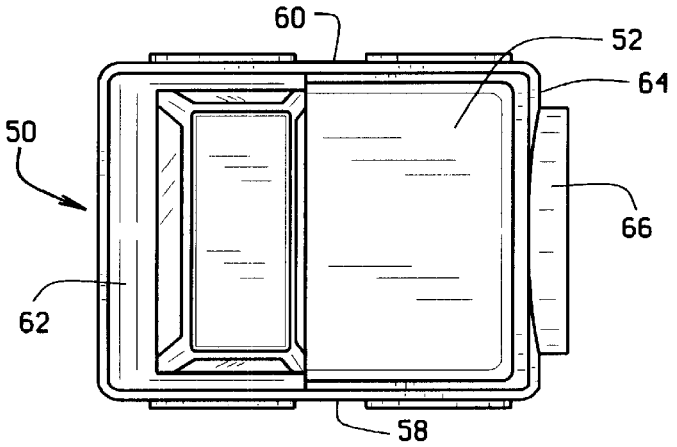
FIG. 13 is a top plan view of the truck shown in FIG. 8.

Opposing front and rear surfaces 62, 64, respectively, extend between the top and bottom surfaces 52, 54 and opposing side surfaces 58, 60. The front surface 62, as best seen in FIGS. 9–11, illustrate the front hood, lights area, bumper and front area of the tires 56, while the rear surface 64, in part, represents the bumper and other rear areas of the molded truck 50. In addition, the rear surface includes a cylindrical extension 66 forming a rear entry opening 68 for ingress and egress of children into and out of the molded truck 50. As with the molded car 20, the rear entry opening 68 has a height and width substantially equal to the distance between the top and bottom surfaces and preferably is sufficiently large to permit two children to pass one another during ingress and egress relative to the molded truck 50.

From the above, it will be seen that the molded car 20 and the molded truck 50 have similar corresponding surfaces differing in shape and configuration based on the desired design of the car or truck.

Figure 17:
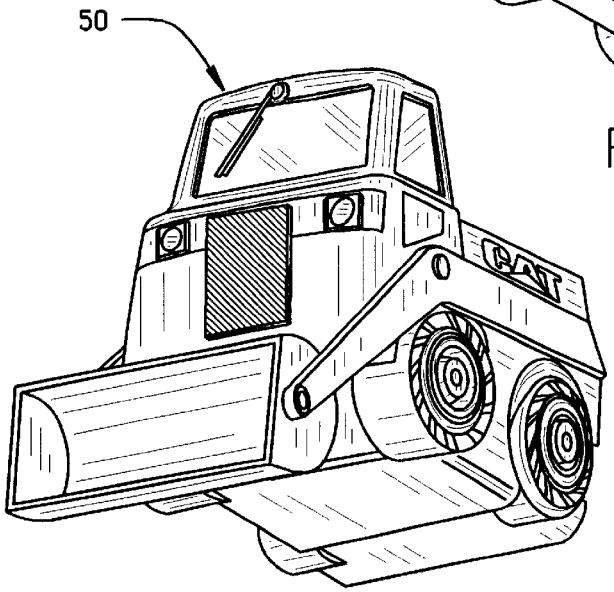
FIG. 17 is a front perspective view of the truck shown in FIG. 8 with different graphics and play accessories to change the look to a bulldozer.

With the multi-purpose generic design/configuration of the molded car 20 and molded truck 50, various graphics and accessories can be added to change the overall look and appearance of the molded car 20 or molded truck 50. For example, in FIG. 15 of the drawings, graphics and accessories have been added to the molded car 20 such that it represents a racing car. In similar fashion, other types of graphics and accessories can be added to change the overall look to a police car, taxi cab and other types of car designs. Similarly, FIGS. 16 and 17 show that graphics and accessories added to the molded truck 50 illustrate different types of trucks. In FIG. 16, a fire truck is illustrated while in FIG. 17, a bulldozer is illustrated. Other types of truck appearances can be changed based on the graphics and accessories that are added to the molded truck 50.

From the foregoing, it will now be appreciated that the children's molded play car/vehicle of the present invention provides a light weight, durable and realistically looking molded car or vehicle that facilitates ingress and egress of children into and out of the molded car or truck, while enabling the overall look and appearance to be readily changed by simply adding different types of graphics and accessories.

In view of the above, it will be seen that the several objects and advantages of the present invention have been achieved and other advantageous results have been obtained.

What is claimed is:

1. A one-piece molded plastic vehicular enclosure for children having a length substantially greater than its width and height and including:

opposing top and bottom surfaces;

opposing side surfaces interconnecting the top and bottom surfaces;

a front surface extending between the top and bottom surfaces and side surfaces; and a single entry opening in the rear opposing the front surface for ingress and egress of children into and out of the vehicular enclosure, the rear entry opening having a height and width substantially equal to the distance between the top and bottom surfaces to facilitate ingress and egress into the vehicular enclosure by children.

2. The vehicular enclosure as defined in claim 1 in which the rear entry opening is generally circular in shape.

3. The vehicular enclosure as defined in claim 1 in which the vehicular enclosure is a car.

4. The vehicular enclosure as defined in claim 1 in which the vehicular enclosure is a truck.

5. The vehicular enclosure as defined in claim 1 in which the vehicular enclosure includes windows to facilitate viewing by children.

6. The vehicular enclosure as defined in claim 5 in which non-transparent window areas are removed from the vehicular enclosure and replaced by transparent windows attached to the enclosure.

7. The vehicular enclosure as defined in claim 1 including tubular structure connected to the rear entry opening through which children crawl to enter and exit the vehicular enclosure.

8. The vehicular enclosure as defined in claim 1 including play accessories within the vehicular enclosure simulating driving components including a steering wheel.

9. The vehicular enclosure as defined in claim 1 including graphics and accessories to visually change the overall look of the vehicular enclosure.

10. The vehicular enclosure as defined in claim 1 in which the rear entry opening is sufficiently large to permit two children to pass one another during ingress and egress relative to the vehicular enclosure.

11. A one-piece molded plastic vehicular enclosure for children having a length substantially greater than its width and height and including:

opposing top and bottom surfaces;

opposing side surfaces interconnecting the top and bottom surfaces;

opposing front and rear surfaces extending between the top and bottom surfaces and side surfaces; and the rear surface including a cylindrical extension forming a rear entry opening for ingress and egress of children into and out of the vehicular enclosure, said rear entry opening being the sole opening for entry into, and out of the vehicular enclosure, the rear entry opening having a height and width substantially equal to the distance between the top and bottom surfaces to facilitate ingress and egress into the vehicular enclosure by children.

12. The vehicular enclosure as defined in claim 11 in which the vehicular enclosure is a car.

13. The vehicular enclosure as defined in claim 11 in which the vehicular enclosure is a truck.

14. The vehicular enclosure as defined in claim 11 in which the vehicular enclosure includes windows to facilitate viewing by children.

15. The vehicular enclosure as defined in claim 11 including tubular structure connected to the rear entry opening through which children crawl to enter and exit the vehicular enclosure.

16. The vehicular enclosure as defined in claim 11 in which the rear entry opening is sufficiently large to permit two children to pass one another during ingress and egress relative to the vehicular enclosure.

* * * * *